US009481486B2

(12) United States Patent
Nameth et al.

(10) Patent No.: US 9,481,486 B2
(45) Date of Patent: Nov. 1, 2016

(54) CONTAINER WITH SECURE AUDIBLE CLOSURE

(71) Applicants: Kraft Foods Group Brands LLC, Northfield, IL (US); Graphic Packaging International, Inc., Menasha, WI (US)

(72) Inventors: Tracy L. Nameth, Chicago, IL (US); Bradley J. Burke, Glendale Heights, IL (US); Ronald R. Werts, III, Waupun, WI (US); Tracy Brock, Waupun, WI (US); Todd Ruhbusch, Holmen, WI (US)

(73) Assignees: Kraft Foods Group Brands LLC, Chicago, IL (US); Graphic Packaging International, Inc., Menasha, WI (US)

( * ) Notice: Subject to any disclaimer, the term of this patent is extended or adjusted under 35 U.S.C. 154(b) by 0 days.

(21) Appl. No.: 14/848,952

(22) Filed: Sep. 9, 2015

(65) Prior Publication Data

US 2015/0375891 A1 Dec. 31, 2015

Related U.S. Application Data

(63) Continuation of application No. PCT/US2014/021042, filed on Mar. 6, 2014.

(60) Provisional application No. 61/785,378, filed on Mar. 14, 2013.

(51) Int. Cl.
*B65D 5/20* (2006.01)
*B65D 5/54* (2006.01)

(52) U.S. Cl.
CPC ..... *B65D 5/2057* (2013.01); *B65D 5/2076* (2013.01); *B65D 5/5425* (2013.01); *B65D 2203/12* (2013.01)

(58) Field of Classification Search
CPC .. B65D 5/5465; B65D 5/545; B65D 5/2057; B65D 5/5425; B65D 5/2076; B65D 2203/12
USPC ..... 229/225, 228
See application file for complete search history.

(56) References Cited

U.S. PATENT DOCUMENTS 2,369,385 A 2/1945 Carruth et al.
2,396,310 A 3/1946 Yungblut (Continued)

FOREIGN PATENT DOCUMENTS

WO WO-2011/071774 6/2011

OTHER PUBLICATIONS

International Search Report and Written Opinion for International Application No. PCT/US2014/021042, dated Aug. 27, 2014, 14 pages.

*Primary Examiner* — Gary Elkins
(74) *Attorney, Agent, or Firm* — Foley & Lardner LLP

(57) ABSTRACT

A re-closeable folded container includes a hexahedral base including a front panel and a rear panel, a cover pivotally connected with an upper edge of a rear panel for movement between an open position and a closed position, and a locking panel hingedly connected with an upper edge of the front panel. The front panel includes a tear-away portion defined by a score line. The locking panel includes a first tab, a second tab, and a tear-away portion defined by score lines. The tear-away portion of the locking panel is fixedly attached to both the front portion of the cover and the tear-away portion of the front panel such that initial movement of the cover from the closed position toward the open position causes the locking panel and the front panel to tear along the score lines and causes both tear-away portions to pivotally move with the cover.

24 Claims, 10 Drawing Sheets

(56) References Cited

U.S. PATENT DOCUMENTS

| | | | | | |
|---|---|---|---|---|---|
| 2,906,444 | A | | 9/1959 | Weiss et al. | |
| 2,963,214 | A | | 12/1960 | Leone et al. | |
| 3,073,501 | A | | 1/1963 | Williamson | |
| 3,078,030 | A | | 2/1963 | Gorton | |
| 3,125,280 | A | | 3/1964 | Henry | |
| 3,191,848 | A | | 6/1965 | Meyers | |
| 3,206,102 | A | | 9/1965 | Henry et al. | |
| 3,283,991 | A | | 11/1966 | Hughes | |
| 3,294,309 | A | | 12/1966 | Coe | |
| 3,310,222 | A | | 3/1967 | Buttery | |
| 3,338,505 | A | | 8/1967 | Hughes | |
| RE26,471 | E | * | 10/1968 | Meyers | B65D 5/5425 229/132 |
| 3,900,158 | A | | 8/1975 | Berkhouse | |
| 4,113,104 | A | * | 9/1978 | Meyers | B65D 5/5425 206/807 |
| 4,141,449 | A | | 2/1979 | Stone | |
| 4,284,197 | A | | 8/1981 | Meyers | |
| 4,310,093 | A | * | 1/1982 | Manser | B65D 5/5425 229/225 |
| 4,314,643 | A | * | 2/1982 | Forbes, Jr. | B65D 5/548 206/807 |
| 4,688,677 | A | | 8/1987 | Roccaforte | |
| 4,863,035 | A | | 9/1989 | Hiroshima | |
| 5,203,495 | A | | 4/1993 | Jorgensen-Beck et al. | |
| 5,314,114 | A | | 5/1994 | Stone | |
| 5,373,960 | A | * | 12/1994 | Gunn | B65D 5/46024 229/117.19 |
| 5,505,374 | A | | 4/1996 | Stone | |
| 5,515,996 | A | | 5/1996 | Stone | |
| 5,553,773 | A | | 9/1996 | Focke et al. | |
| 7,669,755 | B2 | | 3/2010 | Smalley | |
| 2007/0108263 | A1 | | 5/2007 | Nash | |
| 2009/0001145 | A1 | * | 1/2009 | Hasse | B65D 5/543 229/117.12 |
| 2011/0253776 | A1 | | 10/2011 | Craft et al. | |

* cited by examiner

CONTAINER WITH SECURE AUDIBLE CLOSURE

CROSS-REFERENCE TO RELATED APPLICATION

This application is a continuation of International Application No. PCT/US2014/021042, filed Mar. 6, 2014, entitled "CONTAINER WITH SECURE AUDIBLE CLOSURE", which claims the benefit of U.S. Provisional Patent Application No. 61/785,378, filed Mar. 14, 2013, entitled "CONTAINER WITH SECURE AUDIBLE CLOSURE," both of which are incorporated herein by reference in their entireties.

BACKGROUND

The present disclosure relates generally to containers formed from a foldable sheet material and more particularly to a secure re-closeable paperboard container.

Paperboard containers are used extensively in packaging a wide variety of products. Many of these products can be conveniently stored in the container after the container is initially opened. However, many paperboard containers are unable to reclose or fail to remain closed after an initial opening. In the case of many consumer products (e.g., food products, cleaning products, etc.), this failure to remain closed may lead to spillage, leakage, or spoilage of the contents within the paperboard container. Previous attempts to develop an effective re-closeable paperboard container have resulted in complex designs which consume significantly more paperboard and require additional effort to manufacture or assemble.

Many paperboard containers include a tamper-evident feature such as a seal or a tear-away strip. These containers are initially opened by breaking the seal. Tamper-evident packaging ensures consumers that the container has not been previously opened. However, such features may be difficult or expensive to manufacture, thereby increasing the cost of the container and the product contained therein. Accordingly, there exists a need for a simple and effective paperboard container which overcomes the disadvantages associated with conventional paperboard container designs.

SUMMARY

One implementation of the present disclosure is a re-closeable container. The container includes a base having opposing front and rear panels, opposing side walls extending between the front and rear panels, and a bottom panel connected with lower edges of the front, rear, and side walls. The front panel includes a tear-away portion defined by a score line. The container further includes a cover pivotally connected with an upper edge of the rear panel for movement between an open position and a closed position, the cover having a top portion extending between the front and rear panels when the cover is in the closed position, and a front portion connected with the top portion and disposed in close parallel alignment with the front panel when the cover is in the closed position. The container further includes a locking panel hingedly connected with an upper edge of the front panel and disposed between the front panel of the base and the front portion of the cover when the cover is in the closed position, the locking panel having a first tab, a second tab, and a tear-away portion defined by score lines. The tear-away portion of the locking panel is fixedly attached to both the front portion of the cover and the tear-away portion of the front panel such that initial movement of the cover from the closed position toward the open position causes the locking panel and the front panel to tear along the score lines and causes both tear-away portions to pivotally move with the cover. In some embodiments, the tearing of the locking panel forms a pair of engagement surfaces projecting from an inner surface of the front portion of the cover. The first and second tabs are configured to engage the engagement surfaces for securing the cover in the closed position and the engagement is accompanied by at least one of an audile feedback and a tactile feedback.

Another implementation of the present disclosure relates to a method for constructing a re-closeable container. The method includes providing a base having opposing front and rear panels, opposing side walls extending between the front and rear panels, and a bottom panel connected with lower edges of the front, rear, and side walls, wherein the front panel includes a tear-away portion defined by a score line. The method further includes providing a cover pivotally connected with an upper edge of the rear panel for movement between an open position and a closed position, the cover having a top portion extending between the front and rear panels when the cover is in the closed position, and a front portion connected with the top portion and disposed in close parallel alignment with the front panel when the cover is in the closed position. The method further includes providing a locking panel hingedly connected with an upper edge of the front panel and disposed between the front panel of the base and the front portion of the cover when the cover is in the closed position, the locking panel having a first tab, a second tab, and a tear-away portion defined by score lines. The method further includes fixedly attaching the tear-away portion of the locking panel to the tear-away portion of the front panel and fixedly attaching the tear-away portion of the locking panel to an inner surface of the front portion of the cover with the cover in the closed position such that the fixed attachments cause tearing of the locking panel and the front panel along the score lines upon moving the cover from the closed position toward the open position.

In some embodiments, the tearing of the front panel forms a first engagement surface projecting from an edge of the tear-away portion of the front panel and a second engagement surface projecting from an edge of a fixed portion of the front panel. The fixed portion of the front panel may include an alignment surface substantially perpendicular to the second engagement surface and disposed between the second engagement surface and the bottom panel. Orienting a surface of the tear-away portion of the locking panel in parallel abutment with the alignment surface may cause the first engagement surface to align with the second engagement surface.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
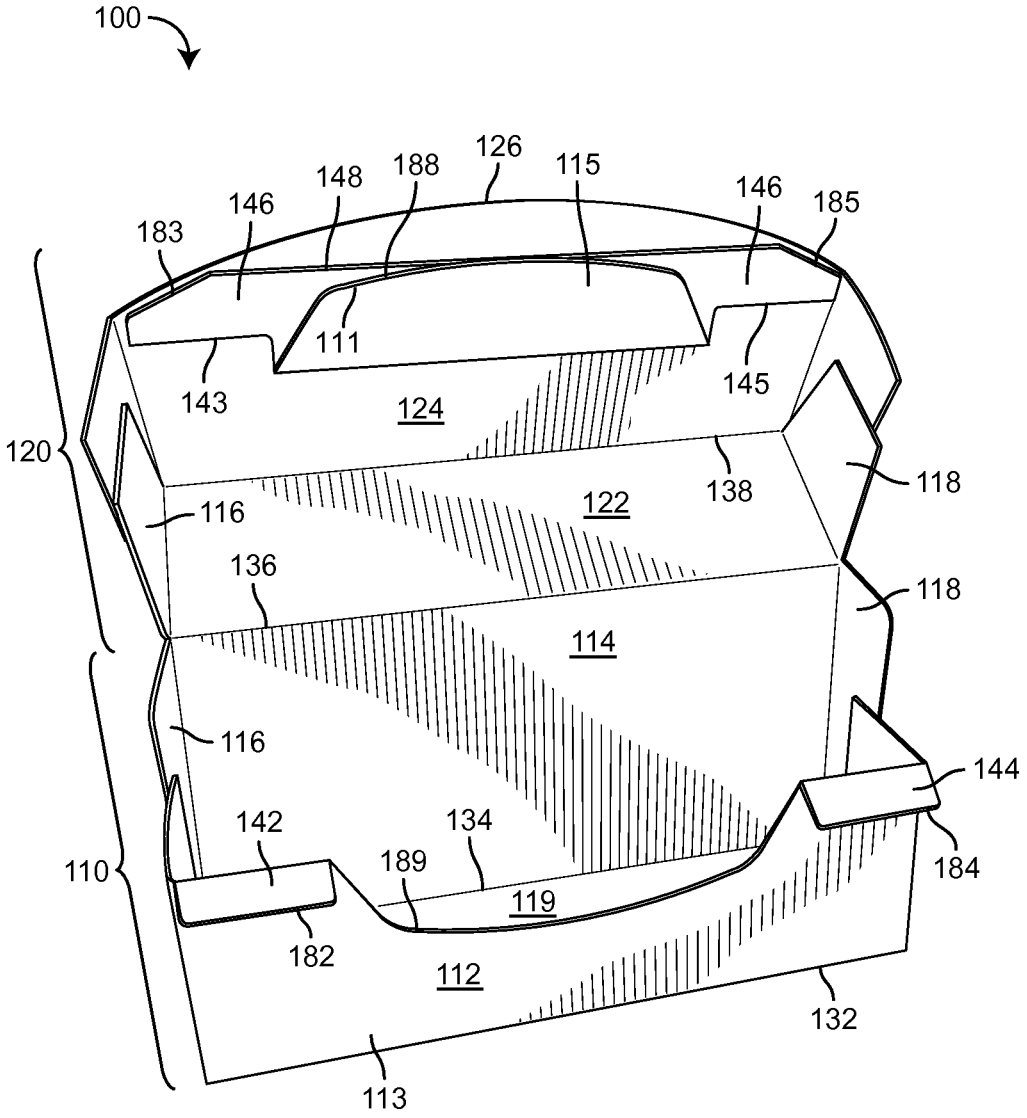
FIG. 1 is a drawing of a re-closeable folded container having a base, a cover pivotally attached to a rear panel of the base, and a locking panel hingedly attached to a front panel of the base, illustrating the cover in an open position and with tear-away portions of the front panel and the locking panel fastened to an inner surface of the cover, according to an exemplary embodiment.

Before discussing the details of the re-closeable folded container and/or the components thereof, it should be noted that references to "front," "back," "rear," "side," "upper," "lower," "inner," "outer," "right," and "left" in this description are merely used to identify the various elements as they are oriented in the FIGURES. These terms are not meant to limit the element which they describe, as the various elements may be oriented differently in various applications.

It should further be noted that for purposes of this disclosure, the terms "coupled" or "attached" mean the joining of two members (e.g., surfaces, edges, panels, etc.) directly or indirectly to one another. Such joining may be stationary in nature or moveable in nature. Such joining may be achieved with the two members or the two members and any additional intermediate members. Such joining may be permanent in nature (e.g., fixedly attached, secured, bonded, etc.) or temporary in nature (e.g., releasably attached, engaged, etc.).

Referring generally to the FIGURES, a re-closeable folded container and components thereof are shown according to an exemplary embodiment. In some implementations, the container may be used for packaging food products. The container may be made of any type of foldable sheet material (e.g., paperboard, paper, cardboard, sheet metal, foldable plastics, etc.). In some embodiments, the container may be constructed from a die-cut paperboard blank. According to other embodiments, the paperboard blank may be provided as a preglued sleeve or tube that is deliverable to a cartoner for filling the container and closing/sealing the carton. All such variations are intended to be included within the scope of this disclosure.

The re-closeable folded container may be a six-sided rectangular container including a front panel, a bottom panel, a rear panel, and a plurality of side panels which interlock and/or overlap to form left-side and right-side walls. The size and shape of the side panels may be optimized via an advantageous die cut pattern to facilitate rapid manufacturing and/or packaging operations and to make efficient use of the folded sheet material. The container includes a re-closeable cover pivotally attached (e.g., along a fold line) with an upper edge of the rear panel and movable between an open position and a closed position. In some embodiments, the cover includes a top portion which is parallel to the bottom panel when the cover is in the closed position and a front portion which is in close parallel alignment with the front panel when the cover is in the closed position.

Advantageously, the front panel may be hingedly attached along an upper edge to a locking panel. The locking panel may include one or more perforated tabs along the hinged edge. The locking panel may be folded into parallel abutment with an outward-facing surface of the front panel. The locking panel includes a tear-away portion which is fixedly attached to an inner surface of the front portion of the cover. When the container is initially opened, the tear-away portion may break free from the hinged tabs. Upon re-closure, the tabs may reengage the tear away portion fixedly attached to the cover for securing the cover in the closed position. Such reengagement may be accompanied by an audible or tactile feedback (e.g., a click, a snap, etc.) indicating a successful re-closure.

Figure 2:
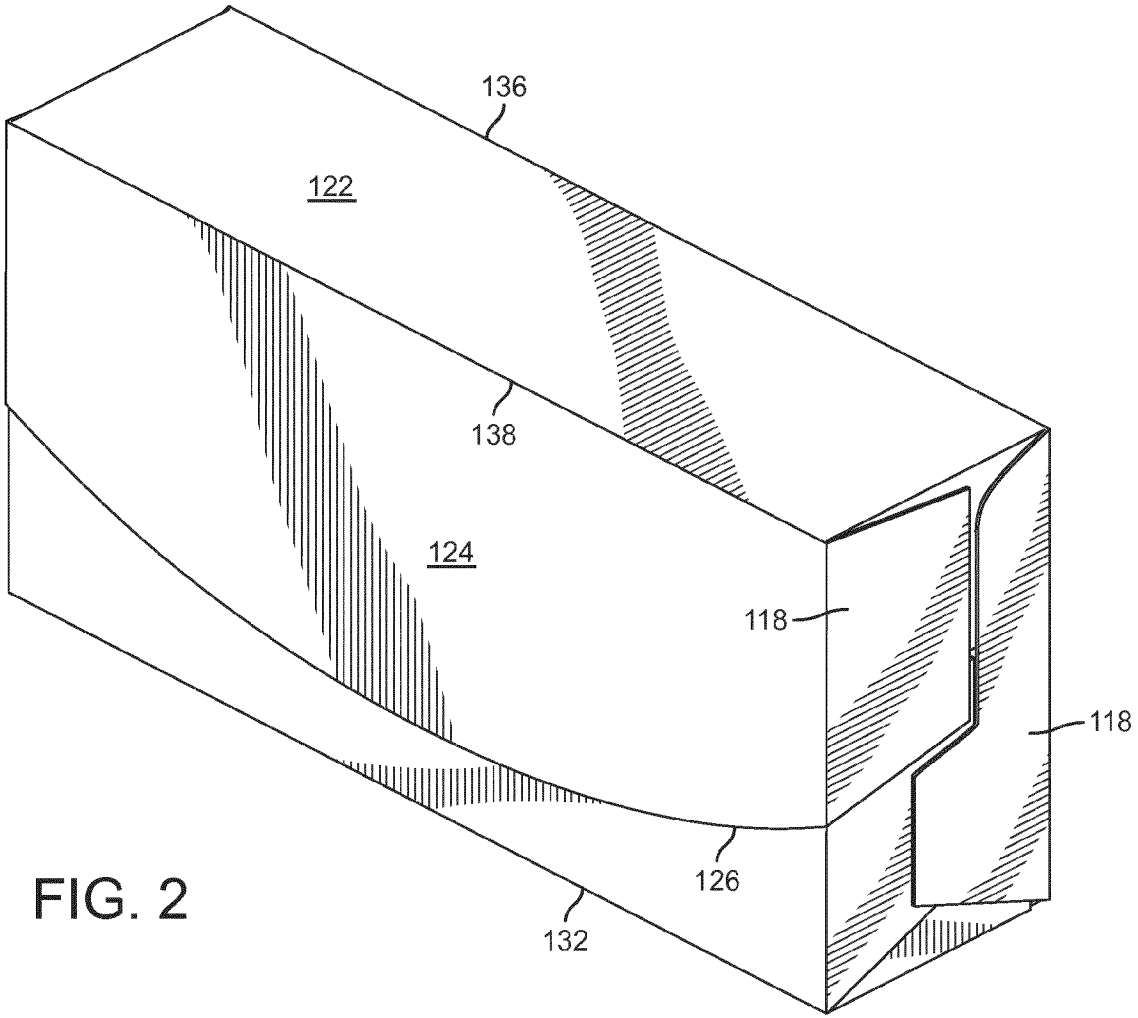
FIG. 2 is a drawing of the re-closeable folded container illustrating the cover in a closed position, according to an exemplary embodiment.

Referring now to FIGS. 1 and 2, a re-closeable folded container 100 is shown, according to an exemplary embodiment. In some embodiments, container 100 may be constructed from a die-cut paperboard blank. In other embodiments, container 100 may be made of any type of foldable sheet material (e.g., paperboard, paper, cardboard, sheet metal, foldable plastics, etc.). Container 100 is shown as a rectangular hexahedral (e.g., six-sided) container having a base 110, a cover 120 pivotally connected with base 110, and locking tabs 142,144 for securing cover 120 in a closed position.

Base 110 is shown to include a front panel 112 and an opposing rear panel 114. Front panel 112 and rear panel 114 may be flat, parallel panels offset by a pair of opposing side walls 116,118. Side walls 116,118 may be parallel side walls (e.g., a left-side wall and a right-side wall) extending between front panel 112 and rear panel 114. Base 110 is further shown to include a bottom panel 119 connected with lower edges of front panel 112, rear panel 114, and side walls 116,118.

In some embodiments, front panel 112, rear panel 114, and/or bottom panel 119 may by substantially rectangular panels formed from a single layer of folded sheet material. For example, a larger rectangular panel may be folded in two locations (e.g., fold line 132 and fold line 134) to form front panel 112, rear panel 114, and bottom panel 119. Side walls 116,118 may be formed from a plurality of interlocking and/or overlapping side panels hingedly connected front panel 112, rear panel 114, or bottom panel 119. In some embodiments, side walls 116,118 may be partially formed by one or more panels attached to a portion of cover 120. The side panels may be fastened together (e.g., via an adhesive) for holding container 100 in a folded condition.

Still referring to FIGS. 1 and 2, container 100 is shown to include a cover 120. Cover 120 may be rotatable relative to base 110 for movement between an open position (e.g., shown in FIG. 1) and a closed position (e.g., shown in FIG. 2). Cover 120 is shown to include a top portion 122 and a front portion 124. Top portion 122 may be a flat rectangular panel pivotally connected with an upper edge of rear panel 114 along a fold line 136. When cover 120 is in the closed position, top portion 122 may be oriented substantially parallel to bottom panel 119.

Front portion 124 is shown as a flat panel attached to top portion 122 along a fold line 138. Front portion 124 may be disposed in close parallel alignment with front panel 112 when cover 120 is in the closed position. In some embodiments, front portion 124 includes a curved bottom edge 126. Edge 126 may provide an aesthetically pleasing visual appearance for container 100 (e.g., by emulating the appearance of a "smile"). In some embodiments, front panel 112 also includes a curved edge 113. Edge 113 may have a radius of curvature substantially equivalent to the radius of curvature of edge 126.

In some embodiments, container 100 may have a width (e.g., a distance between side walls 116,118) exceeding both a height (e.g., a distance between bottom panel 119 and top portion 122) and a depth (e.g., a distance between front panel 112 and rear panel 114) of container 100. In some embodiments, the dimensions of container 100 may be selected such that container 100 has a height-to-width aspect ratio substantially equivalent to a depth-to-height aspect ratio. For example, the ratio of the distance between bottom panel 119 and top portion 112 (e.g., the container height) to the distance between left wall 116 and right wall 118 (e.g., the container width) may be substantially equivalent to the ratio of the distance between front panel 112 and rear panel 114 (e.g., the container depth) to the distance between bottom panel 119 and top portion 112 (e.g., the container height). In some embodiments, one or more aspect ratios of container 100 may be close (e.g., within 15%, within 20%, etc.) to the "aesthetic golden ratio" (i.e., about 1:1.618).

Still referring to FIGS. 1 and 2, container 100 is shown to include locking tabs 142,144. Tabs 142,144 may be pivotally attached to an upper edge of front panel 112. Tabs 142,144 may be configured to engage one or more surfaces (e.g., surfaces 143,145) projecting from an inner surface of front portion 124 when cover 120 is in the closed position. For example, tab 142 may be configured to engage surface 143 and tab 144 may be configured to engage surface 145. In some implementations, tabs 142,144 may be used for securing (e.g., locking, holding, fastening, etc.) cover 120 in the closed position. Advantageously, the engagement between tabs 142,144 and surfaces 143,145 may provide a tactile and/or audile feedback (e.g., a click, a snap, etc.) upon such engagement, thereby providing assurance that cover 120 has been secured in the closed position.

Figure 3:
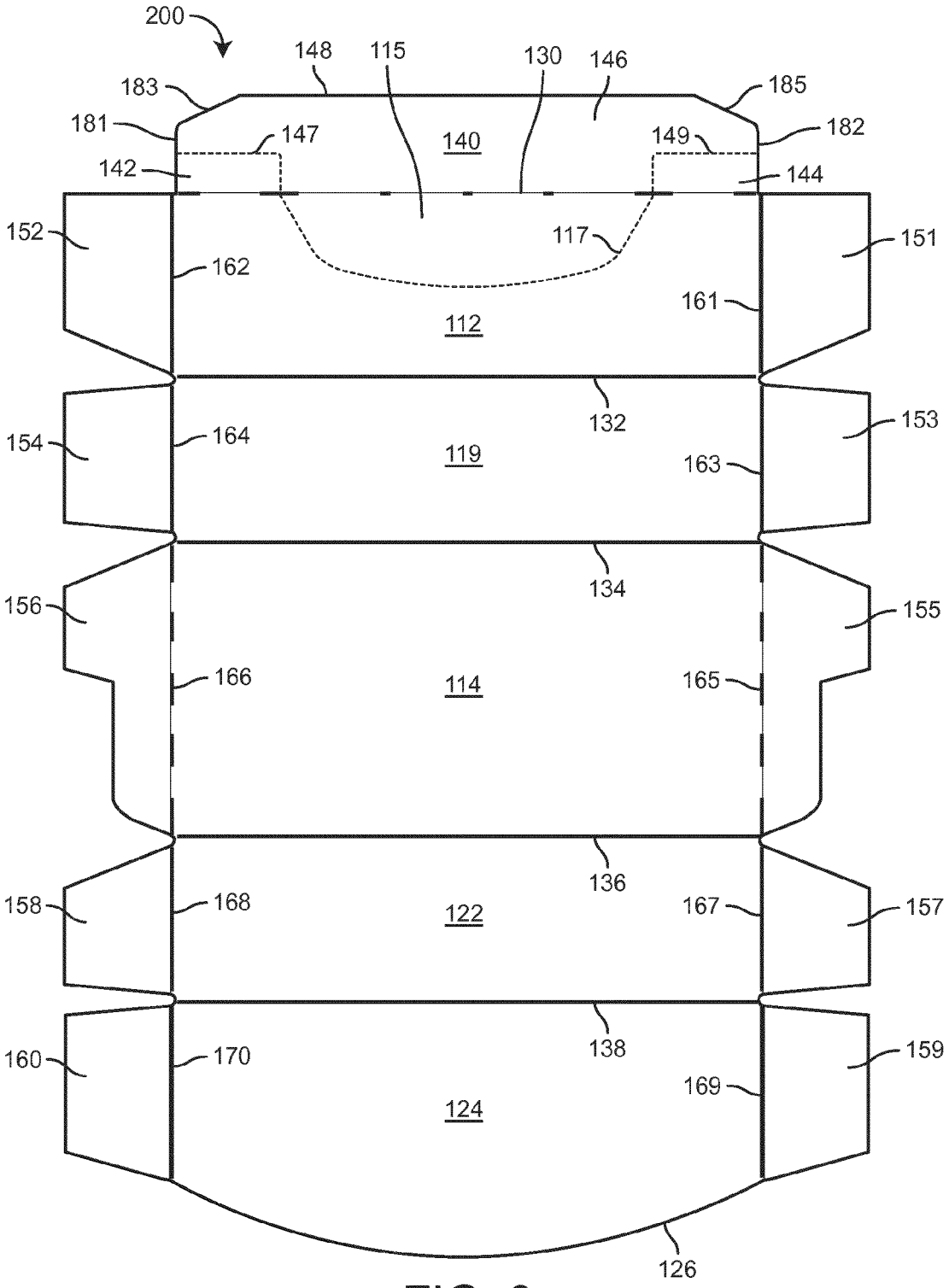
FIG. 3. is a plan view of a die-cut paperboard blank which may be used to construct the re-closeable folded container of FIG. 1, showing several base panels, cover panels, side panels, and a perforated locking panel separated by various fold lines, according to an exemplary embodiment.

Referring now to FIG. 3, a plan view of a blank 200 which may be used to form container 100 is shown, according to an exemplary embodiment. The surfaces of blank 200 shown in FIG. 3 may form the outer surfaces of container 100. Blank 200 may be a die-cut sheet of paperboard or any other foldable sheet material. In some implementations, blank 200 may be a unitary paperboard sheet having a plurality of panels separated by fold lines. Blank 200 is shown to include several base panels including a front panel 112, a bottom panel 119, and a rear panel 114. Front panel 112 and bottom panel 119 are separated by fold line 132. Bottom panel 119 and rear panel 114 are separated by fold line 134. In some embodiments, panels 112, 114, and 119 may be substantially rectangular panels. In some embodiments, blank 200 may be pre-folded (e.g., creased, bent, etc.) along one or more of the fold lines to facilitate subsequent construction into a folded container.

In some embodiments, front panel 112 includes a fixed portion 113 and a tear-away portion 115. Fixed portion 113 and tear-away portion 115 may be separated by a weakened area or line formed in the material of the blank. For example, the weakened area or line may be defined by an area of relatively reduced thickness, or may have other weakening features such as perforations or scoring (shown by way of example as a score line 117, although any other form of a providing a tear line may be used for the various score lines described herein and are intended to be within the scope of this disclosure). Score line 117 may be a perforated boundary between fixed portion 113 and tear-away portion 115. In some embodiments, score line 117 may be a cut entirely through blank 200 in all but a plurality of connection points (e.g., nicks). The connection points may form a weak connection between fixed portion 113 and tear-away portion 115 such that tear-away portion 115 may be readily separated (e.g., torn-away, removed, detached, etc.) from fixed portion 113 by applying minimal separation force. In some embodiments, the connection points may be short unbroken segments extending between fixed portion 113 and tear-away portion 115. In some embodiments, the connection points may have a width (e.g., in a direction along score line 117) of approximately 0.02 inches. In other embodiments, the connection points may have a larger or smaller width as may be suitable for alternate materials and/or implementations.

Still referring to FIG. 3, blank 200 is shown to further include multiple cover panels including a top portion panel 122 and a front portion panel 124. Top portion panel 122 may be a substantially rectangular panel. Top portion panel 122 is separated from rear panel 114 by fold line 136. Front portion panel 124 is separated from top portion panel 122 by fold line 138. In some embodiments, front portion panel 124 may include a top edge collinear with fold line 138, a pair of side edges collinear with fold lines 169,170, and a bottom edge 126. In some embodiments, bottom edge 126 is a curved edge. Bottom edge 126 may have a radius of curvature substantially equivalent to the radius of curvature of score line 117.

Still referring to FIG. 3, blank 200 is shown to further include a locking panel 140. Locking panel 140 may be hingedly attached to front panel 112 and separated from front panel 112 by fold line 130. In some embodiments, locking panel 140 includes an edge collinear with fold edge 130 and an offset edge 148 parallel to fold line 130. Locking panel 140 may further include a pair of side edges 181 and 182. Each of edges 181,182 may have a first end connected with an end of fold line 130 and a second end opposite the first end. In some embodiments, locking panel 140 may further include a pair of edges 183,185 connecting the second ends of side edges 181,182 (e.g., opposite fold line 130) with the ends of offset edge 148. In some embodiments, edges 183,185 may be curved edges. Edges 183,185 may have a radius of curvature substantially equivalent to the radius of curvature of edge 126.

Locking panel 140 is shown to include a first tab 142, a second tab 144, and a tear-away portion 146. In some embodiments, tabs 142,144 may be hingedly connected to fixed portion 113 of front panel 112. Tabs 142,144 may be rectangular portions of locking panel 140. In some embodiments, tab 142 is attached to front panel 112 along a first end portion of fold line 130 and tab 140 is attached to front panel 112 along a second end portion of fold line 130. In some embodiments, tear-away portion 146 is a substantially "T-shaped" portion of locking panel 140. Tear-away portion 146 may be hingedly connected to tear-away portion 115 of front panel 112.

In some embodiments, tab 142 may be separated (e.g., distinguished, partitioned, etc.) from tear-away portion 146 by a score line 147. Similarly, tab 144 may be separated from tear-away portion 146 by a score line 149. Score lines 147,149 may be perforated boundaries between tear-away portion 146 and tabs 142,144. In some embodiments, score lines 147,149 may be a cut entirely through blank 200 in all but a plurality of connection points (e.g., nicks). The connection points may form a weak connection between tear-away portion 146 and tabs 142,144 such that tear-away portion 146 may be readily separated from fixed portion tabs 142,144 by applying minimal separation force. In some embodiments, the connection points may be short unbroken segments extending between tear-away portion 146 and tabs 142,144. In some embodiments, the connection points may have a width (e.g., in a direction along score line 117) of approximately 0.02 inches. In other embodiments, the connection points may have a larger or smaller width as may be suitable for alternate materials and/or implementations.

In some embodiments, line 130 may be a perforated or partially broken line (e.g., slotted, incrementally cut, etc.). Such perforation may facilitate the rotation locking panel 140 relative to front panel 112. In some embodiments, tabs 142,144 may be attached to fixed portion 113 only at the corners of tabs 142,144 along line 130. For example, a slot or notch may be cut through blank 200 (e.g., along line 130) between the corners of tabs 142,144. This slot may allow tabs 142,144 to rotate more easily relative to fixed portion 113. In some embodiments, the slot may have a length (e.g., along line 130) between 0.4 and 0.7 inches. In some embodiments, the slot may have a length of approximately 0.5 inches. Line 130 may have a plurality of such slots along an entire length of line 130. In some embodiments, the slots may be separated by unbroken portions of line 130. Such unbroken portions may have lengths between 0.16 and 0.18 inches. In some embodiments, the unbroken lengths may be approximately 0.17 inches. In other embodiments, the slot lengths and unbroken lengths may be smaller or larger as may be suitable for alternate materials and/or implementations.

Still referring to FIG. 3, blank 200 is shown to further include a plurality of side panels 151-160. Side panels 151-160 are shown extending outward from the side edges of base panels 112-119 and cover panels 122-124. Side panels 151 and 152 are separated from front panel 112 by fold lines 161 and 162. Side panels 153 and 154 are separated from bottom panel 119 by fold lines 163 and 164. Side panels 155 and 156 are separated from rear panel 114 by fold lines 165 and 166. Side panels 157 and 158 are separated from top portion panel 122 by fold lines 167 and 168. Side panels 159 and 160 are separated from front portion panel 124 by fold lines 169 and 170. In some embodiments, blank 200 may be pre-folded along fold lines 161-170 to facilitate subsequent assembly into container 100. In some embodiments, fold lines 165,166 may be scored (e.g., perforated, partially broken, incrementally cut, etc.) to facilitate folding or to allow removal of side panels 155,156 from container 100.

Upon folding blank 200 into container 100, two or more of side panels 151-160 may overlap and/or interlock to form side walls 116,118 (as shown in FIG. 2). For example, side panels 152,154,156,158,160 may form side wall 116 and side panels 151,153,155,157,159 may form side wall 118. In some embodiments, an adhesive or bonding agent may be applied between overlapping portions of side panels 151-160. The adhesive may hold together (e.g., bond, attach, secure, fasten, etc.) overlapping panels 151-160. In other embodiments, other fastening devices (e.g., staples, welds, rivets, clamps, etc.) may be used for fastening overlapping panels. Such fastening may maintain, container 100 in a folded, three-dimensional condition.

Figure 4:
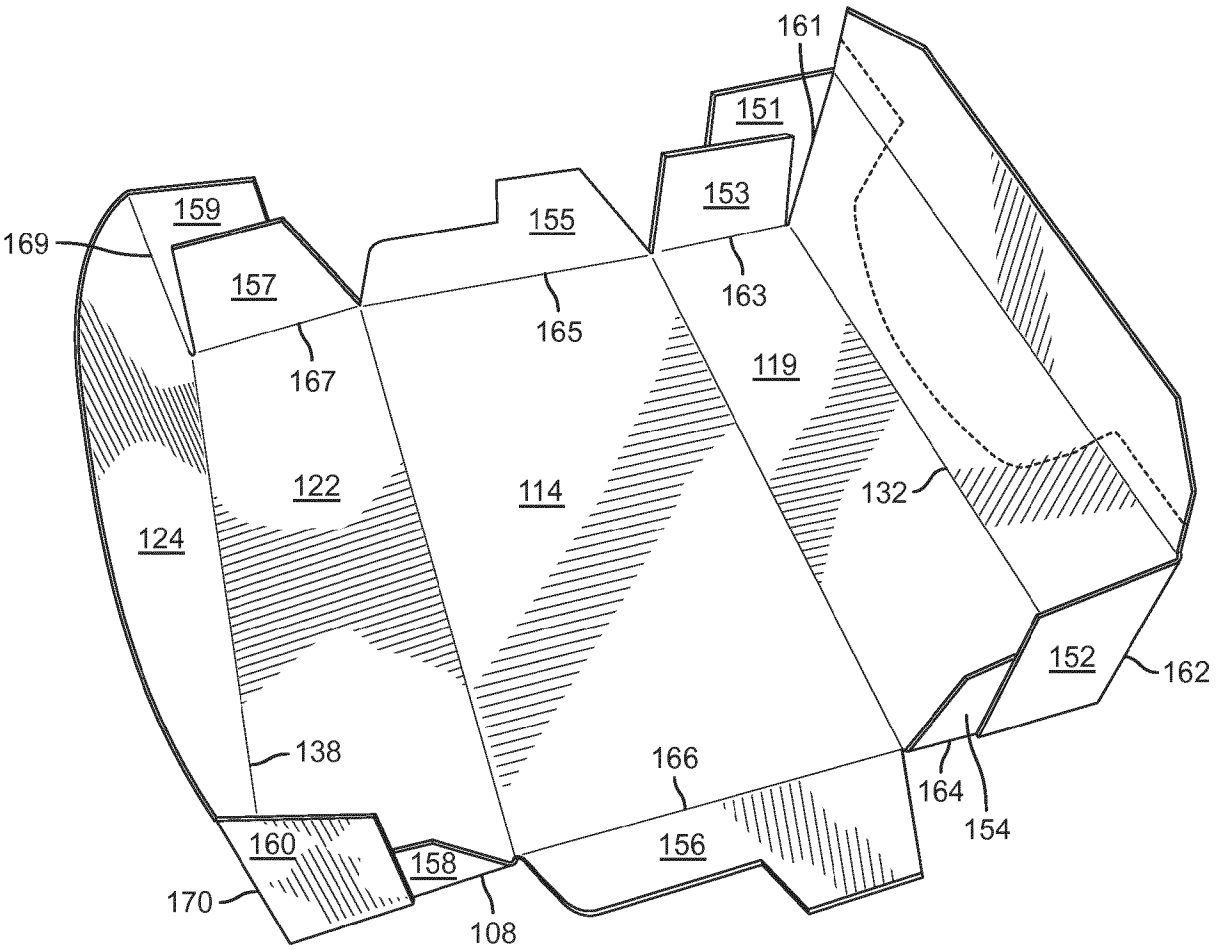
FIG. 4 is a drawing of the die-cut paperboard blank in a partially folded condition, showing several folds along the fold lines separating the base panels, cover panels, and side panels, according to an exemplary embodiment.

Referring now to FIG. 4, container 100 is shown in a partially folded condition, according to an exemplary embodiment. In FIG. 4, blank 200 has been flipped from the perspective shown in FIG. 3 such that the surfaces visible in FIG. 3 are shown facing downward in FIG. 4. Container 100 may be assembled by folding blank 200 along fold line 138. Side panels 157 and 159 may be folded along fold lines 167,169 and fastened together. Side panels 158 and 160 may be folded along fold lines 168,170 and fastened together. In some embodiments, an outward-facing surface of side panels 157,158 may be bonded to an inward-facing surface of side panels 159,160. In other embodiments, an inward-facing surface of side panels 157,158 may be bonded to an outward-facing surface of side panels 159,160.

Container 100 may further be assembled by folding blank 200 along fold line 132. Side panels 151 and 153 may be folded along fold lines 161,163 and fastened together. Side panels 152 and 154 may be folded along fold lines 162,164 and fastened together. In some embodiments, an outward-facing surface of side panels 151,152 may be bonded to an inward-facing surface of side panels 153,154. In other embodiments, an inward-facing surface of side panels 151, 152 may be bonded to an outward-facing surface of side panels 153,154.

Figure 5:
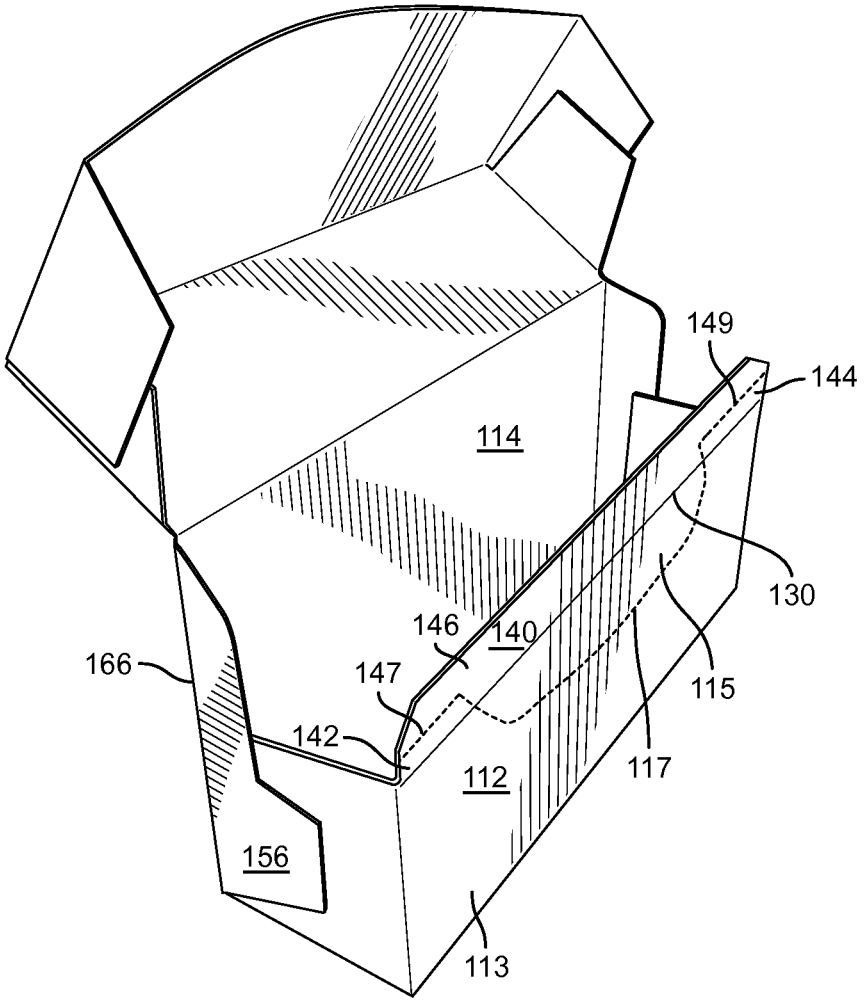
FIG. 5 is a drawing of the die-cut paperboard blank in another partially folded condition, showing additional folds along the fold lines separating the base panels, cover panels, and side panels, according to an exemplary embodiment.

Referring now to FIG. 5, container 100 is shown in another partially folded condition, according to an exemplary embodiment. Container 100 may be transformed from the condition shown in FIG. 4 to the condition shown in FIG. 5 by folding blank 200 along fold line 134. Side panel 155 may be folded along fold line 165 (as shown in FIG. 4) and fastened to the combination of side panels 151 and 153. In some embodiments, an outward-facing surface of side panels 151,153 may be bonded to an inward-facing surface of side panel 155. In other embodiments, an inward-facing surface of side panels 151,153 may be bonded to an outward-facing surface of side panel 155. Side panel 156 may be folded along fold line 156 and fastened to the combination of side panels 152 and 154. In some embodiments, an outward-facing surface of side panels 152,154 may be bonded to an inward-facing surface of side panel 156. In other embodiments, an inward-facing surface of side panels 152,154 may be bonded to an outward-facing surface of side panel 156.

Figure 6:
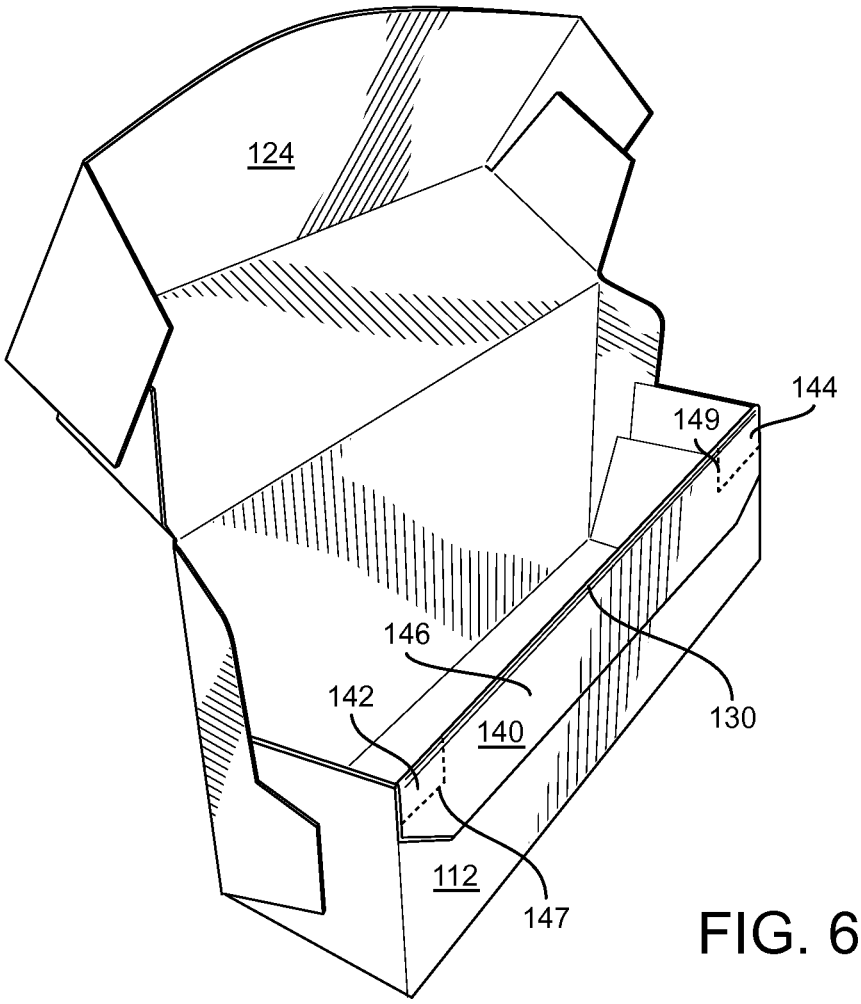
FIG. 6 is a drawing of the die-cut paperboard blank in a completely folded condition, showing the locking panel folded in parallel abutment with the front panel and with the tear-away portion of the locking panel fastened to the tear-away portion of the front panel, according to an exemplary embodiment.

Referring now to FIG. 6, container 100 is shown in a completely folded condition, according to an exemplary embodiment. Container 100 may be transformed from the condition shown in FIG. 5 to the condition shown in FIG. 6 by applying an adhesive (e.g., glue, epoxy, etc.) to an outward-facing surface of tear-away portion 115 (as shown in FIG. 5) and folding locking panel 140 outward and downward by approximately 180 degrees along fold line 130. After such outward folding of locking panel 140, the previously outward-facing surface of tear-away portion 146 to which the adhesive was applied may be disposed in parallel abutment with the outward-facing surface of tear-away portion 115. Tear-away portion 115 may be fixedly attached to tear-away portion 146 via the adhesive layer between tear-away portions 115,146.

In some embodiments, the adhesive between locking panel 140 and front panel 112 may not fasten tabs 142,144 to front panel 112. Accordingly, tabs 142,144 may be free to rotate about fold line 130 if the connection between tabs 142,144 and tear-away portion 146 is broken. In some embodiments, the adhesive between locking panel 140 and front panel 112 may extend only between tear-away portion 146 and tear-away portion 115. In other words, neither tear-away portion 146 nor tabs 142,144 may be fastened to fixed portion 113.

Still referring to FIG. 6, construction of container 100 may be completed by applying an adhesive to an outward-facing surface of tear-away portion 146 (e.g., as shown in FIG. 6) and moving cover 120 into the closed position (e.g., by folding container 100 by approximately 90 degrees along fold line 136). In the closed position, locking panel 140 is disposed between front panel 112 and front portion 124. The adhesive on the outward-facing surface of tear-away portion 146 may fixedly attach tear-away surface 146 to an inward-facing surface of front portion 124.

Referring now to FIGS. 1 and 6, subsequent movement of cover 120 from the closed position toward the open position (i.e., an initial opening) may cause tear-away portion 146 to separate (e.g., detach, tear, etc.) from tabs 142,144 along score lines 147,149. Such separation may be caused by the fixed attachment between tear-away portion 146 and cover 120 via the adhesive between such components. Additionally, the movement of cover 120 from the closed position toward the open position may cause tear-away portion 115 to separate from fixed portion 113 along score line 117. Such separation may be caused by the fixed attachment (e.g., via the adhesive) between tear-away portion 115 and tear-away portion 146. Continued movement of cover 120 toward the open position may cause tear-away portions 115,146 to move (e.g., rotate about fold line 130) along with cover 120.

Advantageously, the separation of tear-away portions 115,146 upon an initial opening of cover 120 may function as a tamper evident feature for container 100. For example, a consumer may reasonably conclude that container 100 has not been opened if tear-away portions 115,146 remain attached to fixed portion 113 and tabs 142,144 respectively. Such tamper evidence may provide a consumer with an assurance of product integrity, quality, and/or freshness with respect to the contents of container 100.

In some embodiments, the separation of tear-away portion 146 from tabs 142,144 may create new surfaces 143, 145, 182, and 184. Surfaces 143,145 are shown projecting from an inner surface of front portion 124 along a side of tear-away portion 146. Surfaces 182,184 are shown opposite fold line 130 extending along a side of tabs 142,144. Each of surfaces 143,145,182,184 may be a rectangular surface having a height equal to the thickness of the sheet material used to form container 100 and a width equal to the width of tabs 142,144. Surface 143 may be configured to align with surface 182 and surface 145 may be configured to align with surface 184 when cover 120 is in the closed position.

Similarly, the separation of tear-away portion 115 from fixed portion 113 may create new surfaces 188 and 189. Surface 188 may be a curved surface along edge 111 of tear-away portion 115. Surface 189 may be a curved surface along a side of fixed portion 113. Each of surfaces 188,189 may have a height equivalent to the thickness of the sheet material used to form container 100 and may follow a path defined by score line 117. Surface 188 may be configured to align with surface 189 when cover 120 is in the closed position. Advantageously, the formation of mating surfaces 143,182; 145,184; and 188,189 via the separation of previously unitary panels may ensure the proper alignment of such surfaces when container 100 is re-closed.

Referring again to FIG. 1, container 100 is shown with cover 120 in the open position, according to an exemplary embodiment. Tear-away portion 146 is shown fixedly attached to an inside surface of front portion 124. Tear-away portion 115 is shown fixedly attached to tear-away portion 146. Tabs 142,144 remain pivotally attached to front panel 112 after container 100 is initially opened. Such pivotal attachment may facilitate the rotation of tabs 142,144 about fold line 130. In some embodiments, edges 183,185 of tear-away portion 146 may align with edge 126 of front portion 124 (e.g., due to equivalent radii of curvature).

As shown in FIG. 1, surface 188 may align with edge 148 at a single point (e.g., due to the linearity of edge 148 and the curvature or surface 188). In other words, surface 188 and edge 148 may be tangentially aligned. In other embodiments, surface 188 may not align with edge 148 at all. Such alignment or misalignment may result in three distinguishable parallel layers at all but a single point along the length of edge 111. For example, a first layer is defined along an inner surface of front portion 124. An intermediate layer is defined between tear-away portions 115 and 146. A third layer is defined along an opposite side of tear-away portion 115 (e.g., the side visible in FIG. 1). Advantageously, the existence of three discrete parallel layers may facilitate the alignment of surface 188 with surface 189 when cover 120 is re-closed after an initial opening.

Figure 7:
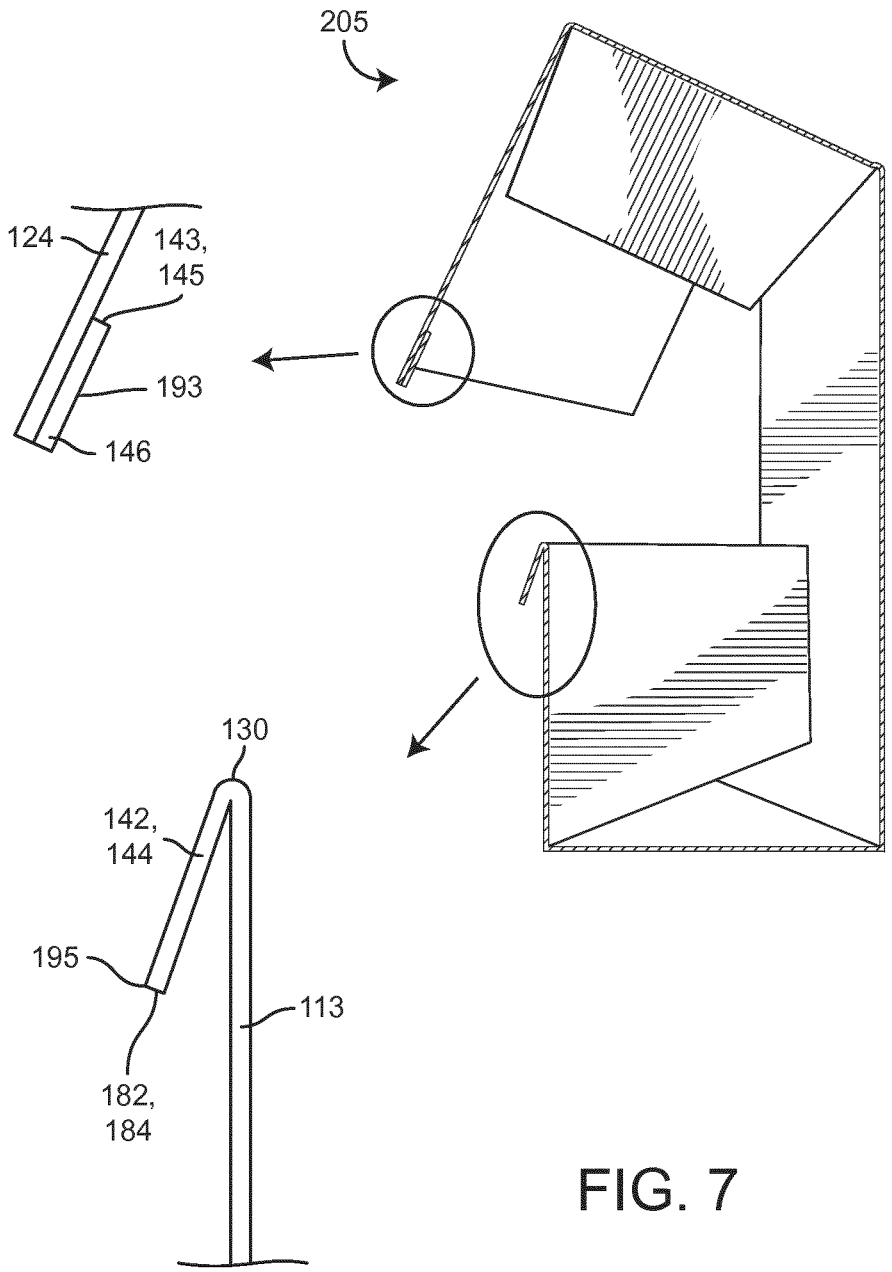
FIG. 7 is a side cross-sectional drawing of the re-closeable paperboard container with the cover in a partially closed position after the tear-away portion of the locking panel has been separated from hinged tabs of the locking panel, according to an exemplary embodiment.
Figure 8:
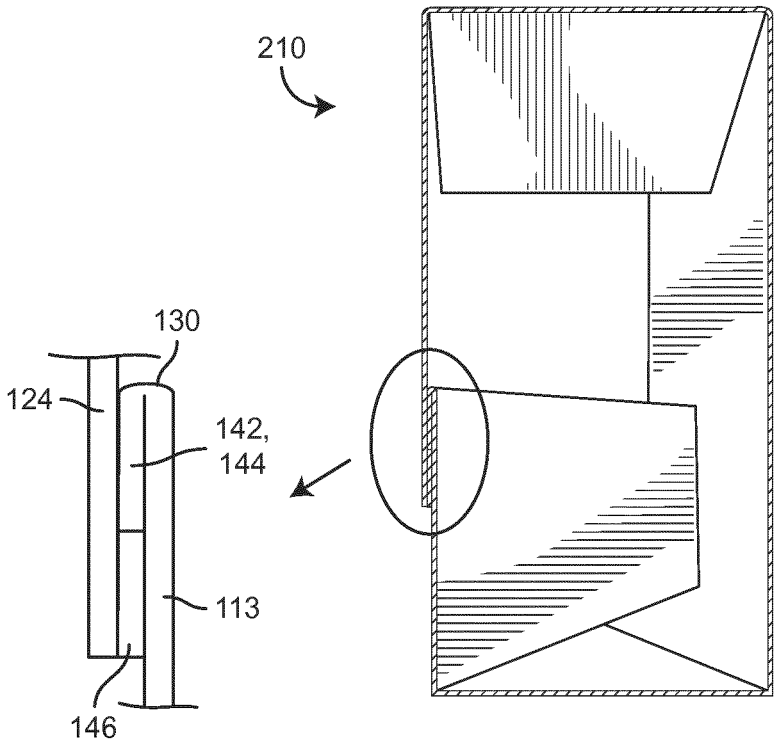
FIG. 8 is a side cross-sectional drawing of the re-closeable paperboard container with the cover in a completely closed position, showing the alignment of the hinged tabs with the tear-away portion of the locking panel, according to an exemplary embodiment.

Referring now to FIGS. 7 and 8, two cross-sections 205 and 210 of container 100 are shown, according to an exemplary embodiment. Cross-sections 205 and 210 are side perspective cross-sections (e.g., looking horizontally from side wall 118 toward side wall 116) taken at a midpoint of tab 142 or tab 144. Cross-section 205 illustrates container 100 with cover 120 in a slightly open position whereas cross-section 210 illustrates container 100 with cover 120 in a closed position.

In some embodiments, when cover 120 is opened, tabs 142,144 may be rotated upwardly and outwardly about fold line 130. It is contemplated that after container 100 has been opened, a portion of the contents may be removed and cover 120 may be returned to the closed position (e.g., to protect and/or preserve the remaining contents). When cover 120 is re-closed, tabs 142,144 may be rotated in a downward and inward direction (e.g., toward fixed portion 113). During such downward and inward rotation, an inward-facing surface 193 of tear-away portion 146 may engage edges 195 of tabs 142,144 (e.g., edges opposite fold line 130). Edges 195 may slide along surface 193 until cover 120 reaches the closed position.

When cover 120 reaches the closed position, tabs 142,144 may "snap" into a secure, closed position in which surfaces 182,184 engage surfaces 143,145. Advantageously, such engagement may be accompanied by an audible and/or tactile feedback (e.g., a snap, a click, etc.) indicative of an effective reclosing. Such engagement may also releasably secure cover 120 in the closed position, thereby preventing container 100 from opening inadvertently.

Figure 9:
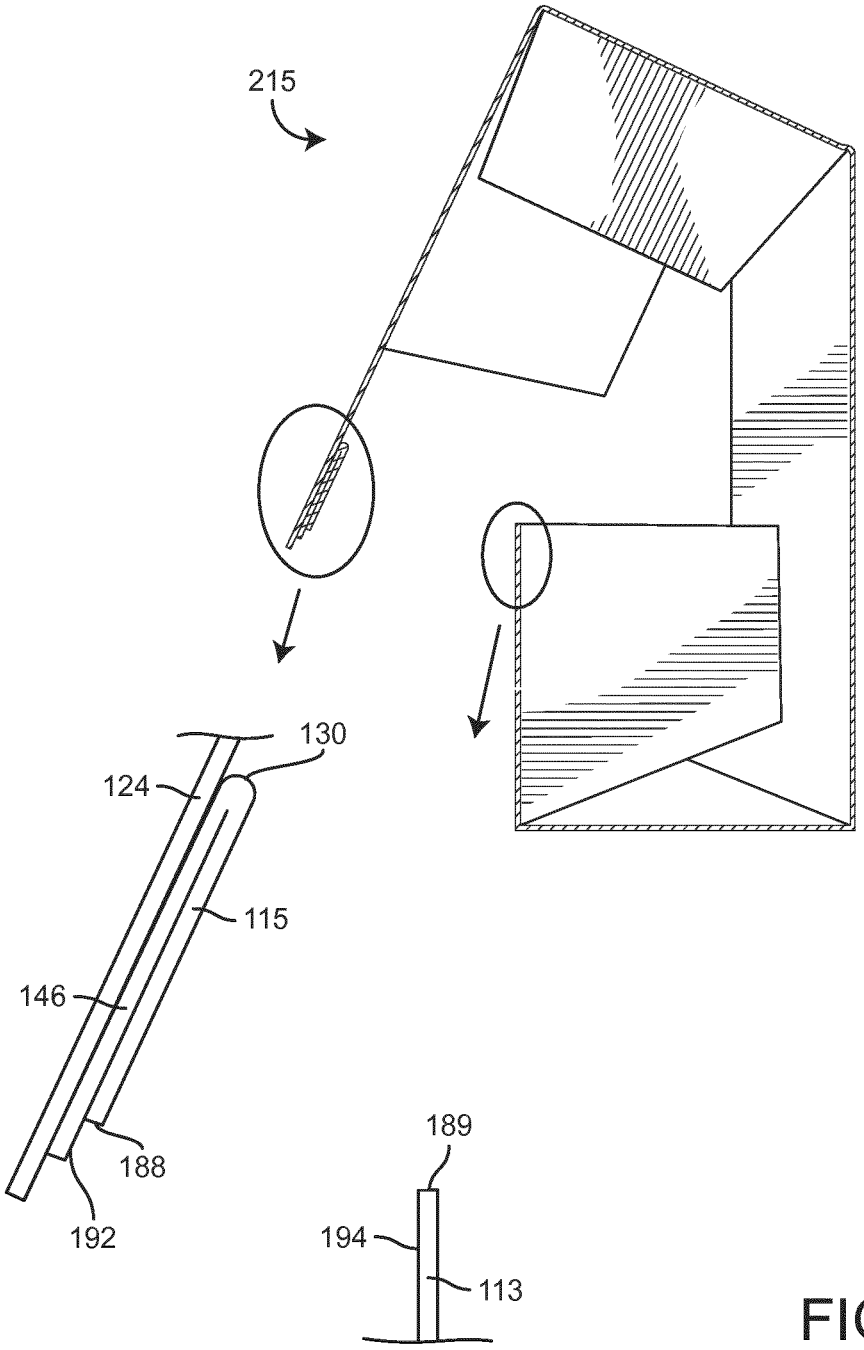
FIG. 9 is a side-cross-sectional drawing of the re-closeable paperboard container with the cover in a partially closed position after the tear-away portion of the front panel has been separated from a stationary portion of the front panel, according to an exemplary embodiment.
Figure 10:
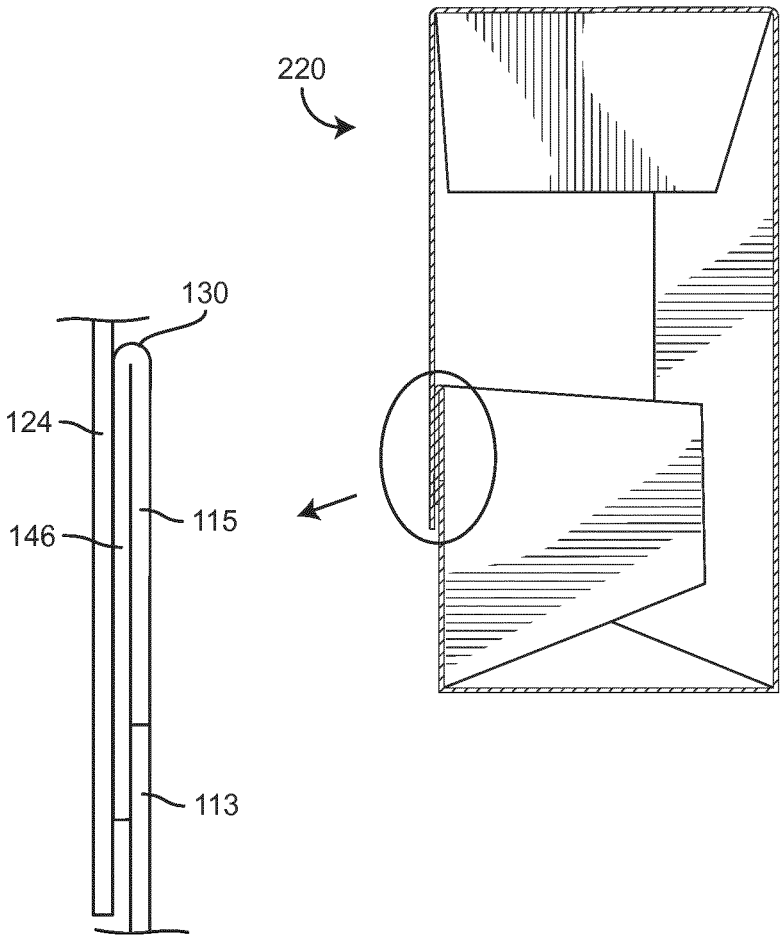
FIG. 10 is a side cross-sectional drawing of the re-closeable paperboard container with the cover in a completely closed position, showing the alignment of the tear-away portion of the front panel with the stationary portion of the front panel, according to an exemplary embodiment.

Referring now to FIGS. 9 and 10, two cross-sections 215 and 220 of container 100 are shown, according to an exemplary embodiment. Cross-sections 215 and 220 are side cross-sections (e.g., looking horizontally from side wall 118 toward side wall 116) taken at a point between tabs 142,144. Cross-section 215 illustrates container 100 with cover 120 in a slightly open position whereas cross-section 220 illustrates container 100 with cover 120 in a closed position.

When cover 120 is rotated into the closed position, top portion 124 may move into close parallel alignment with fixed portion 113. Curved surface 188 may engage curved surface 189 when cover 120 has reached a completely closed position. This engagement between surface 188 and surface 189 may ensure a proper vertical alignment of cover 120 in the closed position. Advantageously, the existence of three parallel layers along the length of edge 111 may facilitate the proper horizontal alignment of mating surfaces 188,189. For example, an inward facing surface 192 of tear-away portion 146 may move into parallel abutment with an outward-facing surface 194 of fixed portion 113. This parallel abutment may ensure that surface 188 is properly horizontally aligned with surface 189. This parallel abutment may also ensure that surfaces 182,184 are properly aligned with surfaces 143,145.

The construction and arrangement of the elements of the re-closeable folded container as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A re-closeable container comprising:

a base having opposing front and rear panels, opposing side walls extending between the front and rear panels, and a bottom panel connected with lower edges of the front, rear, and side walls, wherein the front panel includes a fixed portion and a tear-away portion;

a cover pivotally connected with an upper edge of the rear panel for movement between an open position and a closed position, the cover having a top portion extending between the front and rear panels when the cover is in the closed position, and a front portion connected with the top portion and disposed in close parallel alignment with the front panel when the cover is in the closed position; and a locking panel hingedly connected with an upper edge of the front panel and disposed between the front panel of the base and the front portion of the cover when the cover is in the closed position, the locking panel having a plurality of tabs and a tear-away portion;

wherein the tear-away portion of the locking panel is fixedly attached to both the front portion of the cover and the tear-away portion of the front panel such that initial movement of the cover from the closed position toward the open position causes the tear-away portions of the locking panel and the front panel to tear from the plurality of tabs and the fixed portion respectively and causes both tear-away portions to pivotally move with the cover.

2. The container of claim 1, wherein the tearing of the locking panel forms a plurality of engagement surfaces projecting from an inner surface of the front portion of the cover, wherein the plurality of tabs are configured to engage the plurality of engagement surfaces for securing the cover in the closed position.

3. The container of claim 2, wherein plurality of tabs each include a hinged edge pivotally connected with an upper edge of the front panel and an engagement surface opposite the hinged edge, wherein the engagement surfaces of the first and second tabs are configured to align with the engagement surfaces projecting from the inner surface of the front portion of the cover for securing the cover in the closed position.

4. The container of claim 2, wherein the engagement between the tabs and the engagement surfaces is accompanied by at least one of an audile feedback and a tactile feedback.

5. The container of claim 1, wherein prior to the tearing of the locking panel, the locking panel includes:

a hinged edge connected with an upper edge of the front panel along a fold line;

an offset edge substantially parallel to the hinged edge;

a pair of side edges each having a first end connected with an end of the hinged edge, and a second end opposite the first end; and a pair of non-linear edges connecting the second ends of the pair of side edges with ends of the offset edge.

6. The container of claim 1, wherein the front portion of the cover includes:

a top edge connected with the top portion of the cover along a fold line;

a pair of front-side edges extending from ends of the top edge; and a curved bottom edge extending between the pair of front-side edges.

7. The container of claim 6, wherein the locking panel includes a pair of curved edges having radii of curvature equivalent to a radius of curvature of the curved bottom edge of the front portion of the cover, wherein the pair of curved edges are aligned with the curved bottom edge of the front portion of the cover when the cover is in the closed position.

8. The container of claim 6, wherein the tear-away portion of the front panel includes:

an upper edge connected with an edge of the locking panel along a fold line;

a pair of side edges extending from ends of the upper edge; and a curved lower edge extending between the pair of side edges.

9. The container of claim 8, wherein the curved lower edge of the tear-away portion of the front panel has a radius of curvature substantially equivalent to the radius of curvature of the curved bottom edge of the front portion of the cover.

10. The container of claim 1, wherein the tearing of the front panel forms a plurality of mating surfaces, wherein mating surfaces are configured to align when the cover is secured in the closed position.

11. The container of claim 10, wherein the fixed portion of the front panel includes an alignment surface substantially perpendicular to the second mating surface and disposed between the second mating surface and the bottom panel, wherein orienting a surface of the tear-away portion of the locking panel in parallel abutment with the alignment surface causes the first mating surface to align with the second mating surface.

12. The container of claim 1, wherein an edge of the tear-away portion of the locking panel tangentially intersects an edge of the tear-away portion of the front panel.

13. The container of claim 1, wherein the tear-away portion of the front panel includes a first edge hingedly connected with an edge of the locking panel and a second edge offset from the first edge, wherein an edge of the tear-away portion of the locking panel is disposed between the second edge of the tear-away portion of the front panel and a non-folded edge of the front portion of the cover.

14. The container of claim 1, wherein the hinged connection between the locking panel and the front panel is perforated, wherein the perforation facilitates a rotation of the locking panel relative to the front panel.

15. The container of claim 14, wherein the perforation facilitates a rotation of the plurality of tabs relative to the front panel.

16. The container of claim 14, wherein the perforation includes a plurality of slots extending through a surface of the container along a length of the hinged connection, wherein the slots are separated by unbroken portions of the hinged connection, wherein the slots have a length between 0.4 inches and 0.7 inches.

17. The container of claim 1, wherein each of the plurality of tabs is hingedly connected with the front panel along a perforated fold line, wherein the perforated fold line includes unbroken portions connecting corners of each of the plurality of tabs with the front panel and slots extending between the unbroken portions.

18. A re-closeable container comprising:

a base having opposing front and rear panels, opposing side walls extending between the front and rear panels, and a bottom panel connected with lower edges of the front, rear, and side walls, wherein the front panel includes a fixed portion and a tear-away portion separated by a non-linear score line or perforation line;

a cover pivotally connected with an upper edge of the rear panel for movement between an open position and a closed position, the cover having a top portion extending between the front and rear panels when the cover is in the closed position, and a front portion connected with the top portion and disposed in close parallel alignment with the front panel when the cover is in the closed position, wherein the front portion includes a non-linear edge; and a locking panel hingedly connected with an upper edge of the front panel and disposed between the front panel of the base and the front portion of the cover when the cover is in the closed position, the locking panel having a plurality of tabs and a tear-away portion;

wherein the tear-away portion of the locking panel is fixedly attached to both the front portion of the cover and the tear-away portion of the front panel such that initial movement of the cover from the closed position toward the open position causes the locking panel and the front panel to tear;

wherein the tearing of the locking panel forms a plurality of engagement surfaces projecting from an inner surface of the front portion of the cover, wherein the plurality of tabs are configured to engage the plurality of engagement surfaces for securing the cover in the closed position, wherein the engagement is accompanied by at least one of an audile feedback and a tactile feedback.

19. The container of claim 18, wherein plurality of tabs each include a hinged edge pivotally connected with an upper edge of the front panel and an engagement surface opposite the hinged edge, wherein the engagement surfaces of the plurality of tabs are configured to align with the engagement surfaces projecting from the inner surface of the front portion of the cover for securing the cover in the closed position.

20. The container of claim 18, wherein the non-linear score line separating the fixed portion of the front panel from the tear-away portion of the front panel is a curved score line and the non-linear edge of the front portion of the cover is a curved edge, wherein the curved score line separating the fixed portion of the front panel from the tear-away portion of the front panel and the curved edge of the front portion of the cover have substantially equivalent radii of curvature.

21. A method for constructing a re-closeable container, the method comprising:

providing a base having opposing front and rear panels, opposing side walls extending between the front and rear panels, and a bottom panel connected with lower edges of the front, rear, and side walls, wherein the front panel includes a tear-away portion;

providing a cover pivotally connected with an upper edge of the rear panel for movement between an open position and a closed position, the cover having a top portion extending between the front and rear panels when the cover is in the closed position, and a front portion connected with the top portion and disposed in close parallel alignment with the front panel when the cover is in the closed position;

providing a locking panel hingedly connected with an upper edge of the front panel and disposed between the front panel of the base and the front portion of the cover when the cover is in the closed position, the locking panel having a plurality of tabs and a tear-away portion;

fixedly attaching the tear-away portion of the locking panel to the tear-away portion of the front panel; and fixedly attaching the tear-away portion of the locking panel to an inner surface of the front portion of the cover with the cover in the closed position, wherein the fixed attachments cause tearing of the locking panel and the front panels upon moving the cover from the closed position toward the open position.

22. The method of claim 21, wherein the tearing of the locking panel forms a plurality of engagement surfaces projecting from an inner surface of the front portion of the cover, wherein the plurality of tabs are configured to engage the plurality of engagement surfaces upon moving the cover into the closed position for securing the cover in the closed position.

23. The method of claim 22, wherein the engagement of the tabs with the engagement surfaces is accompanied by at least one of an audile feedback and a tactile feedback.

24. The method of claim 21, wherein the tearing of the front panel forms a first engagement surface projecting from an edge of the tear-away portion of the front panel and a second engagement surface projecting from an edge of a fixed portion of the front panel, wherein the fixed portion of the front panel includes an alignment surface substantially perpendicular to the second engagement surface and disposed between the second engagement surface and the bottom panel, wherein orienting a surface of the tear-away portion of the locking panel in parallel abutment with the alignment surface causes the first engagement surface to align with the second engagement surface.

* * * * *